US007104786B2

(12) United States Patent
Luo

(10) Patent No.: US 7,104,786 B2
(45) **Date of Patent: *Sep. 12, 2006**

(54) CHILDPROOF DISPOSABLE LIGHTER

(76) Inventor: Xing Wen Luo, 5100 Walnut Grove, Unit B, San Gabriel, CA (US) 91776

( * ) Notice: Subject to any disclaimer, the term of this patent is extended or adjusted under 35 U.S.C. 154(b) by 116 days.

This patent is subject to a terminal disclaimer.

(21) Appl. No.: 10/725,098

(22) Filed: Dec. 2, 2003

(65) Prior Publication Data

US 2005/0118546 A1 Jun. 2, 2005

(51) Int. Cl.
*F23Q 2/46* (2006.01)

(52) U.S. Cl. ..... 431/153; 431/276

(58) Field of Classification Search ..... 431/153, 431/144, 138, 277, 276, 274, 273, 267, 255
See application file for complete search history.

(56) References Cited

U.S. PATENT DOCUMENTS 5,769,625 A * 6/1998 Sher ..... 431/153
5,882,186 A * 3/1999 Kai Man ..... 431/153
5,913,674 A * 6/1999 Shimizu ..... 431/153
6,142,768 A * 11/2000 Feng et al. ..... 431/153
6,220,853 B1 * 4/2001 Luo ..... 431/153
6,352,429 B1 * 3/2002 Sher ..... 431/153

FOREIGN PATENT DOCUMENTS

WO WO 98/04869 A1 * 2/1998

* cited by examiner

*Primary Examiner*—Josiah C. Cocks
(74) *Attorney, Agent, or Firm*—Raymond Y. Chan; David & Raymond Patent Group

(57) ABSTRACT

An ignition unit for a lighter includes a striker wheel sandwiched between two driving units wherein each of the driving units includes a driven gear element and a driving cap. The striker wheel urges against a flint with its toothed surface of generating sparks. One of the driving caps is normally rotated about the respective driven gear element in a free rotatably movable manner unless a downward force is intentionally applied on the driving cap while rotating the driving cap to drive the respective driven gear element and said striker wheel to rotate for striking against the flint to produce sparks.

14 Claims, 9 Drawing Sheets

CHILDPROOF DISPOSABLE LIGHTER

BACKGROUND OF THE PRESENT INVENTION

1. Field of Invention

The present invention relates to a disposable childproof lighter, and more particularly to an ignition unit for a disposable childproof lighter, wherein a striker wheel is selectively driven by two driving wheels to rotate or directly driven by an adult user's finger, so as to prevent the disposable childproof lighter from being ignited accidentally or by children.

2. Description of Related Arts

Nowadays, both U.S. government and U.S. Consumer Product Safety Commission demand a safety device in every cigarette lighter including the disposable lighter to prevent unwanted ignition accidentally or by a child. As it is known that the disposable lighter is common and relatively cheap, it is impossible to incorporate with expensive and complex safety device that highly increases the cost of the disposable lighter. In order to minimize the manufacturing cost of the disposable lighter employed with the safety device, one of the most common disposable safety lighter is the driving wheel type disposable safety lighter. This type of disposable lighter comprises a pair of driving wheels for driving the striker wheel to rotate in order to generate sparks, wherein the driving wheels normally run idle when the driving wheels are physically disengaged with the striker wheel.

For example, U.S. Pat. No. 5,547,370, owned by Hwang, discloses a wheel axle mounted between two upright supports at the top of a butane wheel, two driving wheels mounted around the wheel axle and disposed in contact with a spring-supported flint below and turned by the driving wheels through the wheel axle to strike the spring-supported flint in producing sparks. The wheel axle is made of polygonal cross section, having two round rods at two opposite ends loosely inserted into a respective axle hole on each upright support so as to ensure a better connection between the striker wheel and the wheel axle.

Since the dimension of the driving wheels are not produced precisely for minimizing the manufacturing cost of the disposable lighter, there is always a clearance between the driving wheel and the striker wheel. The clearance is supposed to provide a gap that the driving wheels can rotate loosely around the axle in such a manner that the driving wheels are run idle around the axle. However, the clearance also provides a gap that the driving wheels can axially loose such that the driving wheels may not perfectly engage with the wheel axle of the striker wheel in order to provide an optimum mutual friction therebetween for ignition. Furthermore, in order to ignite the lighter, a downward force must apply on the driving wheels for engaging the striker wheel. In fact, due to the contacting surface between the driving wheel and the striker wheel, the disposable lighter is somewhat difficult in operation.

Another example, U.S. Pat. No. 6,220,853, owned by Luo, discloses a striker wheel coaxially sandwiched by two driving caps and a pair of driven gear elements coaxially mounted at two sides of the striker wheel respectively, wherein the driving caps are arranged to engage with the driven gear elements respectively to drive the striker wheel to rotate when a downward force is applied on the driving caps. In other words, the driving caps are run idle at a normal position. However, the each of the driving caps has an outer circumferential knurling surface so that the child is able to strike the driving caps on a floor to engage with the driven gear elements and to rotate the striker wheel.

SUMMARY OF THE PRESENT INVENTION

An objective of the present invention is to provide an ignition unit for a disposable childproof lighter, which prevent the disposable childproof lighter from being ignited accidentally or by children.

Another objective of the present invention is to provide an ignition unit for a disposable childproof lighter, wherein each driving cap of the ignition unit has a smooth slipping surface so that without sufficient force, an user's thumb will slip off the driving cap without causing the rotation of the striker wheel, so as to prevent an unintentional ignition of the disposable childproof lighter.

Another objective of the present invention is to provide an ignition unit for a disposable childproof lighter, wherein the wheel axles of the striker driving wheels are fittingly inserted into the striker wheel, so that the striker driving wheel is able to drive the striker wheel simultaneously against the flint to produce sparks.

Another objective of the present invention is to provide an ignition unit for a disposable childproof lighter, wherein one of the driving caps is normally engaged with one of the striker driving wheel and the other driving caps normally free rotates about the other striker driving wheel, so that an insufficient force applied on the free rotating driving cap by a child user is not able to drive the striker driving wheel to rotate the striker wheel.

Another objective of the present invention is to provide an ignition unit for a disposable childproof lighter, wherein the wheel axles of the striker driving wheels are loosely inserted into the striker wheel, so that the striker wheel normally free rotates with respect to the striker wheel, and a force that intentionally applied to the striker wheel is required to rotate the striker wheel against the flint to produce sparks.

Another objective of the present invention is to provide an ignition unit for a disposable childproof lighter, wherein the driving caps are normally disengaged with the driven gear elements respectively so as to prevent any unwanted ignition of the disposable childproof lighter.

Another objective of the present invention is to provide an ignition unit for a disposable childproof lighter, wherein each of the driving caps can be simply modified by its size to normally engage with the driven gear elements so as to enhance the ignition operation of the disposable childproof lighter without reducing its safety feature.

Another objective of the present invention is to provide an ignition unit for a disposable childproof lighter, wherein the driving caps are tightly fitted with the driven gear elements respectively so as to prevent any unwanted ignition of the disposable childproof lighter.

Another objective of the present invention is to provide an ignition unit for a disposable childproof lighter, wherein each of the driving caps can be simply modified by its size to loosely fit with the driven gear element so as to enhance the ignition operation of the disposable childproof lighter without reducing its safety feature.

Another objective of the present invention is to provide an ignition unit for a disposable childproof lighter, wherein the connection of the driving caps and driven gear element is a combination of the aforementioned manners.

Another object of the present invention is to provide an ignition unit for a disposable childproof lighter, wherein the driving caps are steadily held by the driven gear elements respectively for preventing any axially loose of the driving caps, so as to ensure effective engagement of the driving cap to ignite the disposable childproof lighter.

Accordingly, in order to accomplish the above objects, the present invention provides an ignition unit for a disposable childproof lighter which comprises two supporting walls and a flint supported by a resilient element at a position between the two supporting walls.

The ignition unit, which is adapted for rotatably mounting between the two supporting walls, comprises a strike wheel having a plurality of striking teeth provided on an outer circumferential surface thereof for urging against the flint, two driven gear elements for coaxially mounting the striker wheel between the two supporting walls, and two driving caps.

Each of the driven gear elements comprises a striker driving wheel having an outer circumferential surface and a support shank integrally and coaxially protruded from an inner side of the striker driving wheel, wherein the two support shanks, which are smaller than the two striker driving wheels in diameter, are coaxially mounted on two sides of the striker wheel to define two supporting gaps between the two sides of the striker wheel and the two striker driving wheels respectively, and the two striker driving wheels are arranged for respectively and rotatably mounting to the two supporting walls in such a manner that the striker wheel is capable of being driven to rotate when the two striker driving wheels are driven to rotate.

The two driving caps are embodied as a free rotating driving cap and a fixed driving cap respectively. Each of the driving caps comprises a driving ring and an inner sidewall extending from a circular edge of the driving ring, wherein each of the driving rings has a smooth outer circumferential slipping surface, an inner circumferential surface, and a circular driving cavity formed within the driving ring and the inner sidewall. The driving cavity of the free rotating driving cap has a diameter larger than that of the striker driving wheel of the respective driven gear element such that the free rotating driving cap is normally free rotated with respect to the respective driven gear element. The driving cavity of the fixed driving cap has a diameter slightly larger than that of the striker driving wheel of another driven gear element such that the fixed driving cap is normally engaged with the respective driven gear element. Each of the inner sidewalls has a central support hole for said support shank of the respective driven gear element passing through while the respective striker driving wheel is received in the driving cavity, wherein the two inner sidewalls of said driving caps are disposed in the two supporting gaps respectively so as to hold the two driving caps in a position between the striker wheel and the two driven gear elements respectively. The free rotating driving cap and the fixed driving cap are arranged to engage with the striker driving wheels to drive the driven gear elements to rotate respectively, so as to drive the striker wheel to rotate for striking against the flint to produce sparks.

Alternatively, the striker wheel is normally free rotated with respect to the driven gear elements. Therefore, an adult's thumb is large enough to apply a sufficient pressure on the slipping surfaces of the driving rings to deform a thumb surface of the adult to frictionally engage with the outer circumferential surface of the striker wheel so as to drive the striker wheel to rotate for striking against the flint to produce sparks.

These and other objectives, features, and advantages of the present invention will become apparent from the following detailed description, the accompanying drawings, and the appended claims.

DETAILED DESCRIPTION OF THE PREFERRED EMBODIMENT

Figure 1:
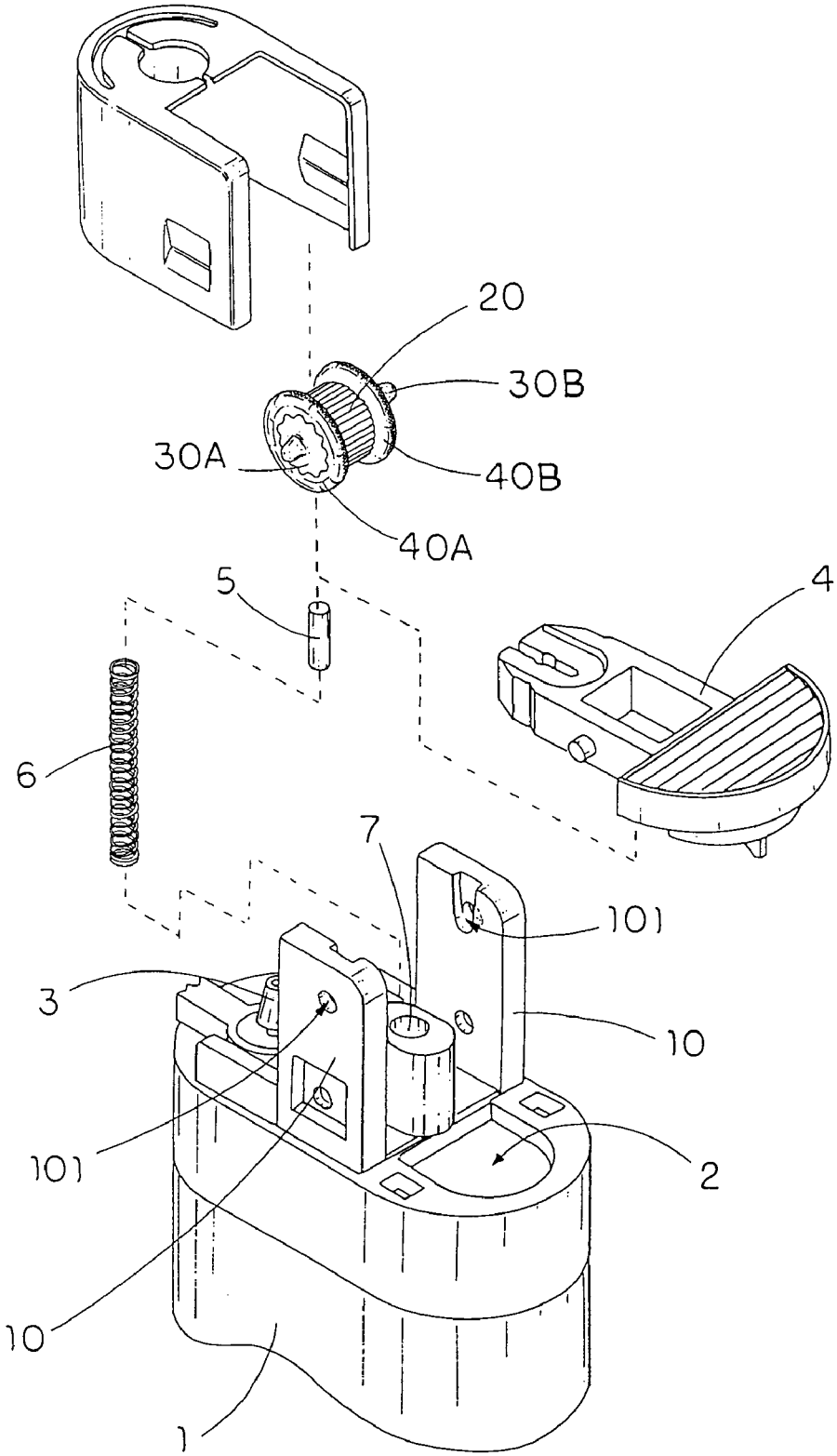
FIG. 1 is a perspective view of an ignition unit for a disposable childproof lighter according to a preferred embodiment of the present invention.

Referring to FIG. 1 of the drawings, an ignition unit, which is adapted for mounting on a disposable childproof lighter, according to a preferred embodiment of the present invention is illustrated, wherein the disposable childproof lighter, such as a conventional disposable lighter, comprises a supporting frame 1 mounted on a gas reservoir 2 which has a gas valve 3 upwardly extended from the supporting frame 1.

The gas valve 3 is actuated by a gas lever 4 to release gas from the gas reservoir 2. The supporting frame 1 comprises a pair of supporting walls 10 parallelly protruded at opposite sides of the gas lever 4 wherein the gas lever 4 is pivotally mounted between the two supporting walls 10 of the supporting frame 1. Each of the supporting walls 10 has a supporting hole 101 provided thereon. A windshield is detachably mounted on the supporting frame 1 to encircle the gas valve 3.

The disposable childproof lighter further comprises a flint 5 supported by a resilient element 6 wherein the flint 5 and the resilient element 6 are received in a flint housing 7 provided between the two supporting walls 10 of the supporting frame 1.

Figure 2:
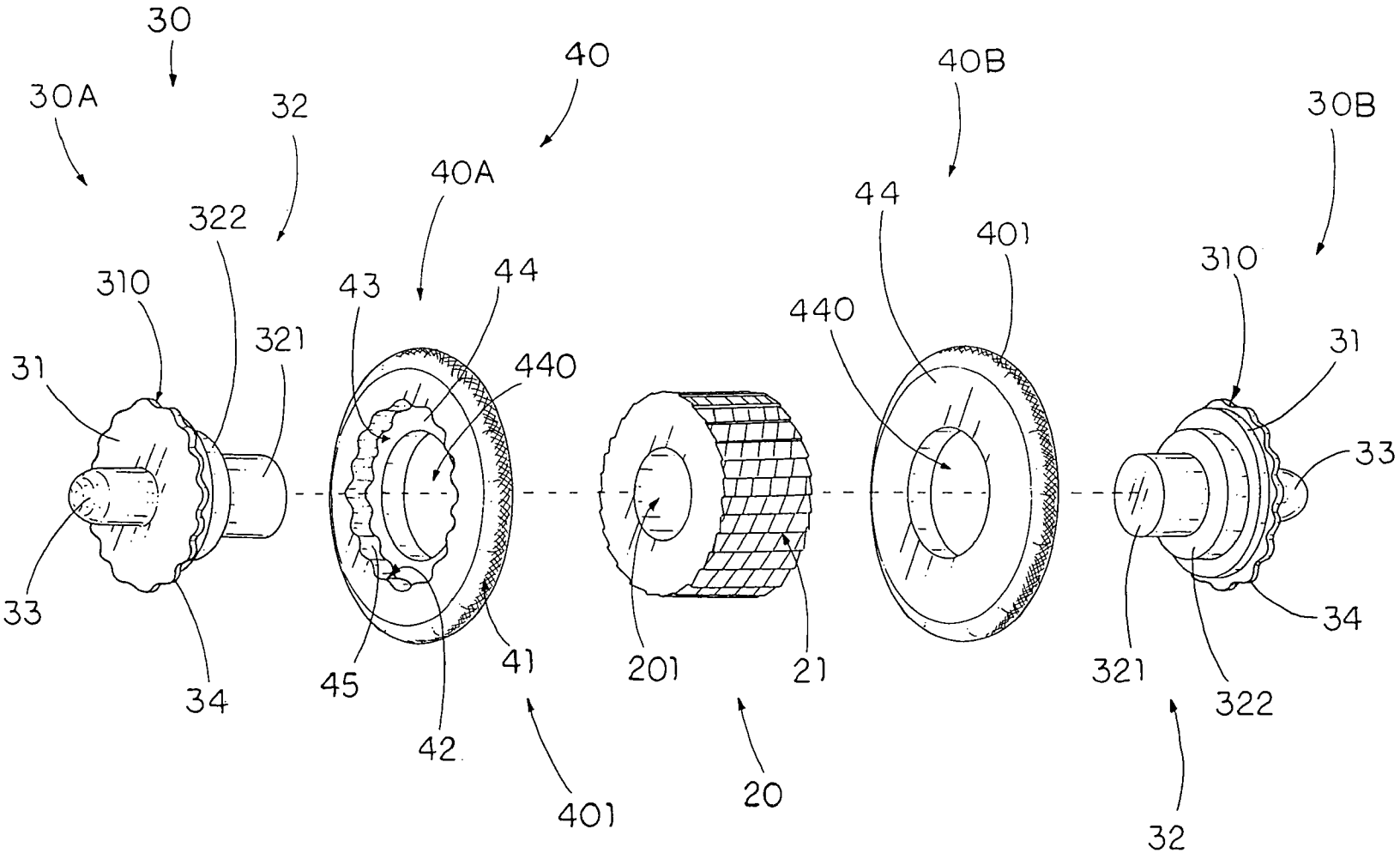
FIG. 2 is an exploded perspective view of the ignition unit for the disposable childproof lighter according to the above preferred embodiment of the present invention.

Referring to FIG. 1 and FIG. 2, the ignition unit comprises a striker wheel 20 having a plurality of striking teeth 21 evenly provided on an outer circumferential surface thereof for urging against the flint 5, and two driving units 80 for coaxially mounting the striker wheel 20 between the two supporting walls 10.

The two driving units 80 respectively comprises two driven gear elements 30, the first driven gear element 30A and the second driven gear element 30B, and two driving caps 40, the free rotating driving cap 40A and fixed driving cap 40B, for driving the striker wheel 20 to rotate through the driven gear elements 30A, 30B respectively.

Figure 3:
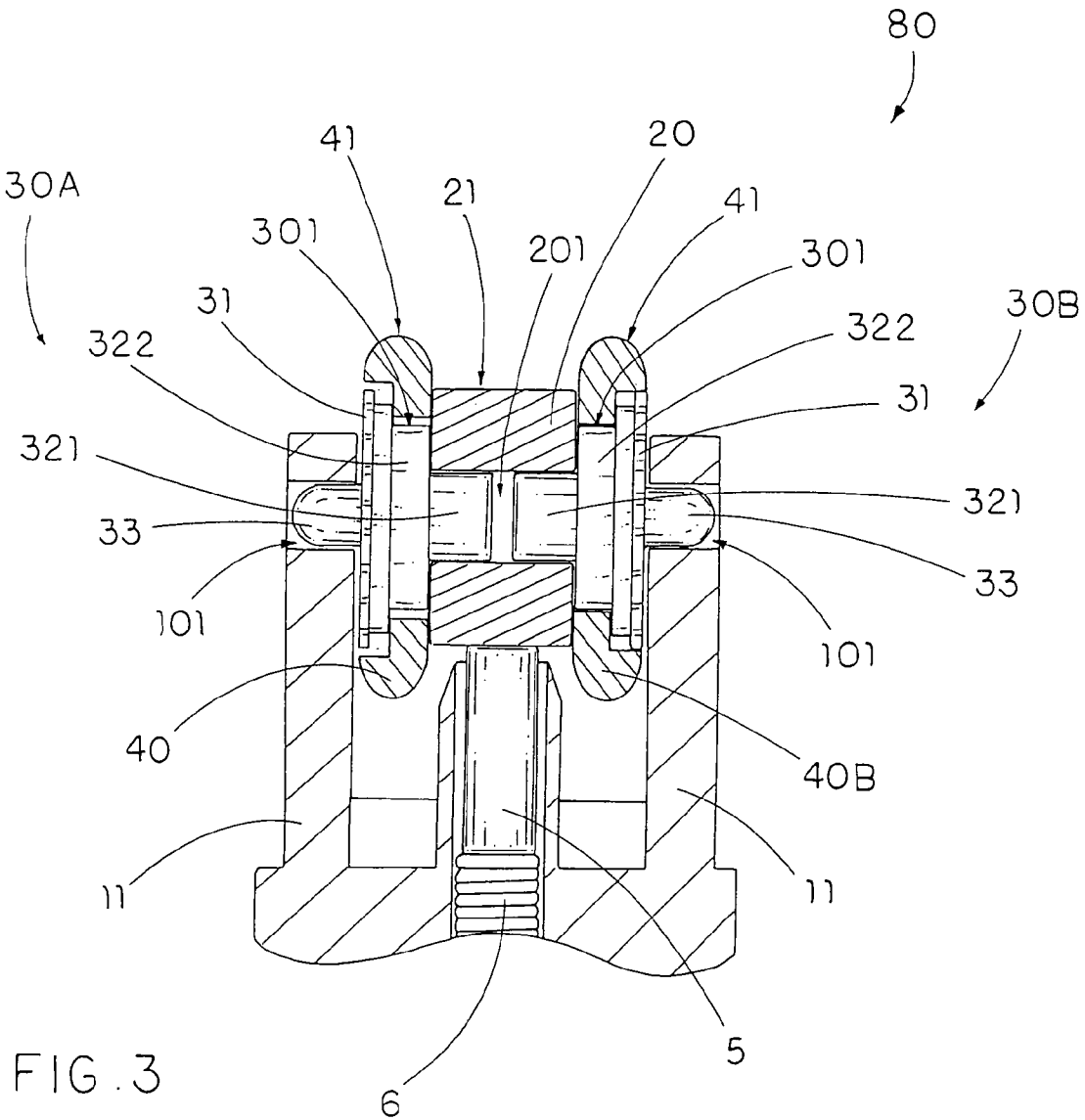
FIG. 3 is a sectional view of the ignition unit for the disposable childproof lighter according to the above preferred embodiment of the present invention.

The first driven gear element 30A and second driven gear element 30B, coaxially mount the striker wheel 20 between the two supporting walls 10, wherein each of them comprises a striker driving wheel 31 having an outer circumferential surface and a support shank 32 integrally and coaxially protruded from an inner side of the striker driving wheel 31. The two support shanks 32 having two wheel axles 321 respectively protruded therefrom are coaxially and tightly inserted on two sides of the striker wheel 20 to define two supporting gaps 301 between the two sides of the striker wheel 20 and the two striker driving wheels 31, respectively, as shown in FIG. 3. The two striker driving wheels 31 are arranged for respectively and rotatably mounting to the two supporting walls 10 in such a manner that that striker wheel 20 is capable of being driven to rotate by the wheel axles 321.

Each of the driving cap 40, i.e. the free rotating driving cap 40A and the fixed driving cap 40B, comprises a driving ring 401 and an inner sidewall 44 extending from a circular edge of the driving ring 401, wherein each of the driving rings 401 has a slipping surface 41 provided on an outer circumferential surface, an inner circumferential surface 42, and a circular driving cavity 43 formed within the driving ring 401 and the inner sidewall 44. The driving cavity 43 of the free rotating driving cap 40A has a diameter so larger than that of the striker driving wheel 31 of first driven gear element 30A that the free rotating driving cap 40A normally free rotates with respect to the first driven gear element 30A. The driving cavity 43 of the fixed driving cap 40B has a diameter substantially identical to that of the striker driving wheel 31 of second driven gear element 30B such that the fixed driving cap 40B normally rotates simultaneously with the second driven gear element 30B. Each of the inner sidewalls 44 has a central support hole 440 for the support shank 32 of the respective driven gear element 30A, 30B passing through while the respective striker driving wheel 31 is received in the driving cavity 43. The two inner sidewalls 44 of the driving caps 40 are disposed in the two supporting gaps 301 respectively so as to hold the two driving caps 40 in a position between the striker wheel 20 and the two driven gear elements 30A, 30B respectively. Thus, the fixed driving cap 40B is capable of directly driving the second driven gear element 30B to rotate the striker wheel 31 against the flint 5 to generate sparks, while a predetermined downward force is required to engage the free rotating driving cap 40A with the striker driving wheel 31 of first driven gear element 30A to drive the striker wheel 20 for generation of sparks.

According to the preferred embodiment, the striker wheel 20, which is a hollow wheel body having a central axial hole 201, is rotatably mounted between the two supporting walls 10 of the supporting frame 1 at a position that the flint 5 is upwardly urged against a portion of the striking teeth 21 in such a manner that the sparks are produced and directed toward the gas valve 3 by driving the striking teeth 21 of the striker wheel 20 to strike against the flint 5.

Each of the support shank 32 comprises a wheel axle 321 and a support wheel 322 which is integrally and coaxially positioned between the striker driving wheel 31 and the wheel axle 321. The two wheel axles 321, which are smaller than the two striker driving wheels 31 in diameter, are coaxially and securely fitted into two ends of the central axial hole 201 of the striker wheel 20 respectively. Each of the two support wheels 322 has a diameter slightly larger than the two wheel axles 321 such that when the two wheel axles 321 are fully inserted into the two ends of the central axial hole 201 of the striker wheel 20, the two supporting gaps 301 are exactly defined between the sides of the striker wheel 20 and the two striker driving wheels 31 respectively.

Each of the driven gear elements 30A, 30B further comprises a supporting shaft 33 coaxially and outwardly extended from the respective striker driving wheel 31 to rotatably insert into the supporting hole 101 of the respective supporting wall 10. Therefore, the two striker driving wheels 31 are respectively and rotatably mounted to the two supporting walls 10 of the supporting frame 1 respectively in such a manner that the striker wheel 20 is capable of being driven to rotate when the two striker driving wheels 31 are driven to rotate.

Accordingly, a total thickness of the striker driving wheel 31 and the support wheel 322 is preferred to be equal to or slightly less than a distance between the respective supporting wall 10 and the opposing side of the striker wheel 20, as shown in FIG. 3.

As shown in FIG. 2 and FIG. 3, the slipping surface 41 of each of the driving caps 40A, 40B is radially projected to form a round outer circumferential surface of the driving ring 401 for enhancing a contacting area thereof, wherein a thickness of the driving ring 401 is gradually reduced from a mid-portion to two outer edges thereof so as to form the round outer circumferential slipping surface 41 of the driving cap 40. Due to the shape of the slipping surfaces 41 of the driving caps 40, an adult is able to deform his or her thumb to enlarge the contacting area between the thumb's surface and the slipping surfaces 41 of the driving caps 40. However, a young child, who has a smaller thumb size, is unable to ignite the disposable childproof lighter since his or her thumb cannot frictionally engage with the slipping surfaces 41 of the driving caps 40 to rotate the striker wheel 20. In addition, the round shape of the slipping surfaces 41 of the driving caps 40, 40' can prevent the young child from striking the driving caps 40 on the floor to rotate the striker wheel 20 for ignition.

An adult user must press his or her thumb on the slipping surfaces 41 of the driving caps 40 in order to establish sufficient gripping friction between the thumb and the slipping surfaces 41 of the driving caps 40 to drive the striker wheel 20 to rotate. In other words, when an insufficient gripping friction applied by a young child on the driving caps 40, the child's thumb will slip off the driving caps 40 without causing the rotation of the striker wheel 20, so as to prevent the disposable childproof lighter from being ignited by children or accidentally.

A width of each of the supporting gaps 301, which is a width of the support wheel 322, should be equal to or slightly larger than a thickness of the inner sidewall 44 of each driving cap 40. According to the preferred embodiment, a diameter of the central support hole 440 of each inner sidewall 44 is slightly larger than a diameter of the respective support wheel 322 such that the inner sidewalls 44 of the two driving caps 40 are rotatably disposed in the two supporting gaps 301 respectively so as to hold the two driving caps 40 in a rotatably movable manner. In other words, the two driving caps 40 are freely rotated within the supporting gaps 301 respectively.

Since the diameter of the driving cavity 43 of the free rotating driving cap 40A is larger than the diameter of the respective striker driving wheel 31 received therein, the free rotating driving cap 40A is capable of being rotated to idle with respect to the first driven gear element 30A. In other words, the free rotating driving cap 40A is normally disengaged with the first driven gear element 30A unless a relatively larger force is applied on the slipping surface 41 of free rotating driving cap 40A by the adult to downwardly press the free rotating driving cap 40A against the striker driving wheel 31 of first driven gear element 30A in order to drive the striker wheel 20 to rotate. Since the young child does not have sufficient power to press down and rotate the free rotating driving cap 40A at the same time, the arrangement of the first driven gear element 30A and the free rotating driving cap 40A can substantially prevent the young child from driving the striker wheel 20 to rotate and ignite the lighter. It is worth to mention that the ignition unit of the present invention provides a dual safety features in one simple structure, which are the slipping surfaces 41 of the driving caps 40 and the idle rotation of the free rotating driving cap 40A, so as to prevent any unwanted ignition of the disposable childproof lighter accidentally or by children.

Figure 4:
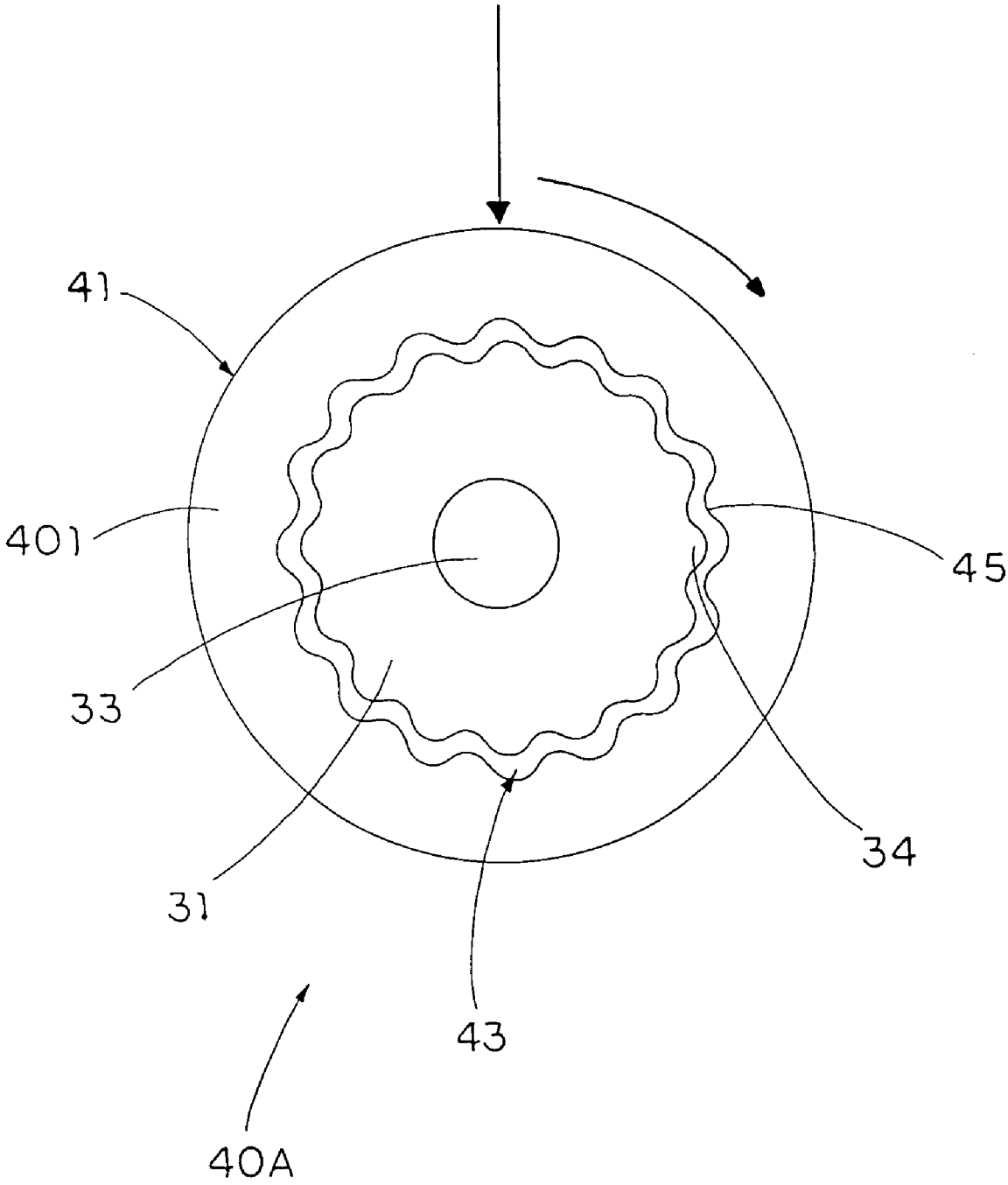
FIG. 4 is a side view of the ignition unit for the disposable childproof lighter according to the above preferred embodiment of the present invention, illustrating the free rotating driving cap.

In order to enhance the engagements between the free rotating driving cap 40A and the first driven gear element 30A, the ignition unit further comprises a plurality of driven gear teeth 34 spacedly provided on the outer circumferential surface 310 of the striker driving wheel 31 of first driven gear element 30A and a plurality of driving teeth 45 spacedly provided on the inner circumferential surface 42 of free rotating driving cap 40A, as shown in FIG. 4, wherein when the free rotating driving cap 40A is pressed to engage the driving teeth 45 with the driven gear teeth 34, the free rotating driving cap 40A is capable of driving the striker driving wheel 31 of first driven gear element 30A to rotate, so as to rotate the striker wheel 20 for ignition.

Accordingly, the driven gear teeth 34 are spacedly and outwardly protruded from an outer edge of the outer circumferential surface 310 of the striker driving wheel 31 of first driven gear element 30A. Correspondingly, the driving teeth 45 of the free rotating driving cap 40A can also be arranged spacedly with respect to the driven gear teeth 34, so that when the free rotating driving cap 40A is pressed down by a predetermined downward force, one of the driving teeth 45 of the free rotating driving cap 40A will be pressed to engage with at least one of the upper driven gear teeth 34 of the striker driving wheel 31 for driving the first driven gear element 30A and the striker wheel 20 to rotate.

In addition, since the inner sidewall 44 of each of the free rotating driving cap 40A is sandwiched between the striker wheel 20 and the striker driving wheel 31 of the first driven gear element 30A, the free rotating driving cap 40A is rotatably held between the striker wheel 20 and the first driven gear element 30A, so as to prevent any unwanted axial loose of the free rotating driving cap 40A for ensuring the precise engagement between the free rotating driving cap 40A and the first driven gear element 30A when the downward force is applied on the free rotating driving cap 40A.

In fact, during assemble, the two driving caps 40A, 40B must be coaxially aligned at two sides of the striker wheel 20 with the two driving cavities 43 facing outward, and then by plugging the two wheel axles 321 of the two support shanks 32 into the two ends of the central axial hole 201 of the striker wheel 20 until the two striker driving wheels 31 of the two driven gear elements 30A, 30B are received in the two driving cavities 43 respectively, as shown in FIG. 3. Therefore, it is impossible to detach the driving caps 40, 40' from the ignition unit after the assembly thereof, so as to enhance the safety structure of the disposable childproof lighter.

Figure 5:
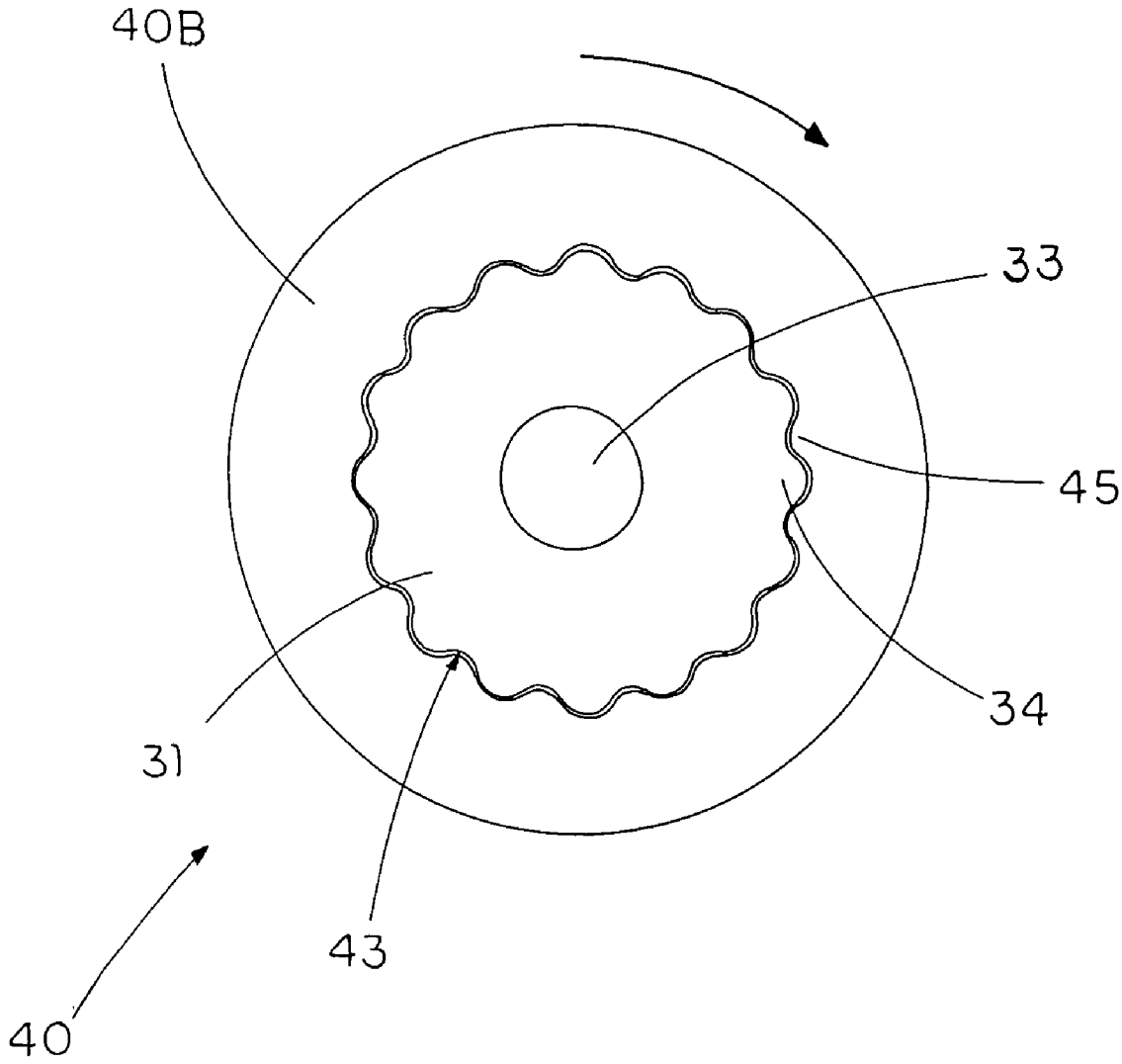
FIG. 5 is side view of the ignition unit for the disposable childproof lighter according to the above preferred embodiment of the present invention, illustrating the fixed driving cap.

FIG. 5 illustrates the engagement between the fixed driving cap 40B and the striker driving wheel 31 of the second driven gear element 30B, wherein the structural design of the ignition unit is remained the same except that the fixed driving cap 40B is normally engaged with the second driven gear element 30B. In other words, the fixed driving cap 40B is not run idle at normal position.

In order to maintain the engagement between the fixed driving cap 40B and the second driven gear element 30B at the normal position, the structural design of each of the fixed driving cap 40B can be simply modified that the diameter of the driving cavity 43 is reduced with respect to the striker driving wheel 31 of second driven gear element 30B.

As shown in FIG. 5, the driving cavity 43 of the fixed driving cap 40B has a predetermined diameter that when the striker driving wheel 31 of second driven gear element 30B is received in the driving cavity 43, the driving teeth 45 of the fixed driving cap 40B are normally engaged with the driven gear teeth 34 of the striker driving wheel 31 of second driven gear elements 30B in such a manner that when the fixed driving cap 40B is rotated the second driven gear elements 30B as well as the striker wheel 20 are responsively driven to rotate for ignition.

Figure 6:
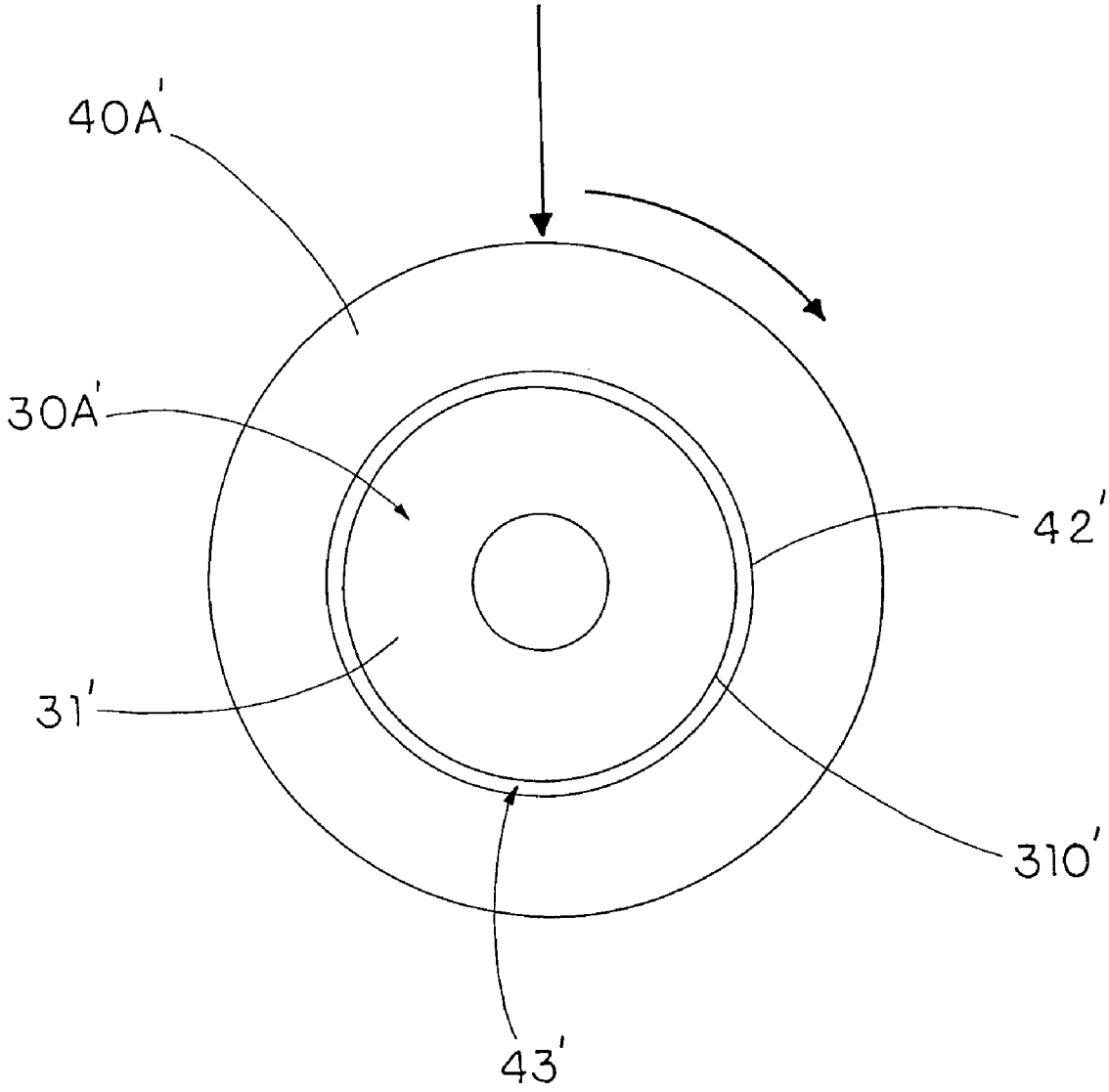
FIG. 6 illustrates an alternative mode of the free rotating driving cap of the ignition unit for the disposable childproof lighter according to the above preferred embodiment of the present invention.

FIG. 6 illustrates an alternative mode of the free rotating driving cap 40A of the ignition unit wherein the structural design of the ignition unit is remained the same except that the outer circumferential surface 310' of striker driving wheel 31' of the first driven gear element 30A' and inner circumferential surface 42' of free rotating driving cap 40A' are substantially smooth, wherein the free rotating driving cap 40A' and the striker driving wheel 31' are loosely fitted to enable the free rotating driving cap 40A' to free rotate about the first driven gear element 30A'.

The circular driving cavity 43' of free rotating driving cap 40A' has a diameter greater than that of the striker driving wheel 31' of first driven gear element 30A' so that, normally, the free rotating driving cap 40A' free rotates with respect to the striker driving wheel 31'. When a predetermined downward force is intentionally applied on the striker driving wheel 31', the friction between the inner circumferential surface 42' of the free rotating driving cap 40A' and outer circumferential surface 310' of striker driving wheel 31' of first driven gear element 30A' enables the free rotating driving cap 40A' to drive the striker driving wheel 31' so as to rotate the striker wheel 20 affixed thereto, as shown in FIG. 3.

In other words, the free rotating driving cap 40A' is normally rotated about the respective driven gear element 30A' in a free rotatably movable manner unless a downward force is intentionally applied on the free rotating driving cap 40A' to frictionally engage the inner circumferential surface 42' of the free rotating driving cap 40A' with the outer circumferential surface 310' of the striker driving wheel 31' of the respective driven gear element 30A' while rotating the free rotating driving cap 40A' to drive the respective driven gear element 30A and the striker wheel 20 to rotate.

Such alternative also prevents a child from accidentally igniting the ignition unit by inadvertently rotating the free rotating driving cap 40A'. This is because a predetermined downward force must be apply on the free rotating driving cap 40A' to generate sufficient friction between the outer circumferential surface 310' and the inner circumferential surface 42' for enabling the free rotating driving cap 40A' to drive the striker driving wheel 31'. The required downward force may be designed greater than the possible force that an average child would exert by studying the fractional behavior of the two contact surfaces in order to achieve the childproof function of the present invention.

Figure 7:
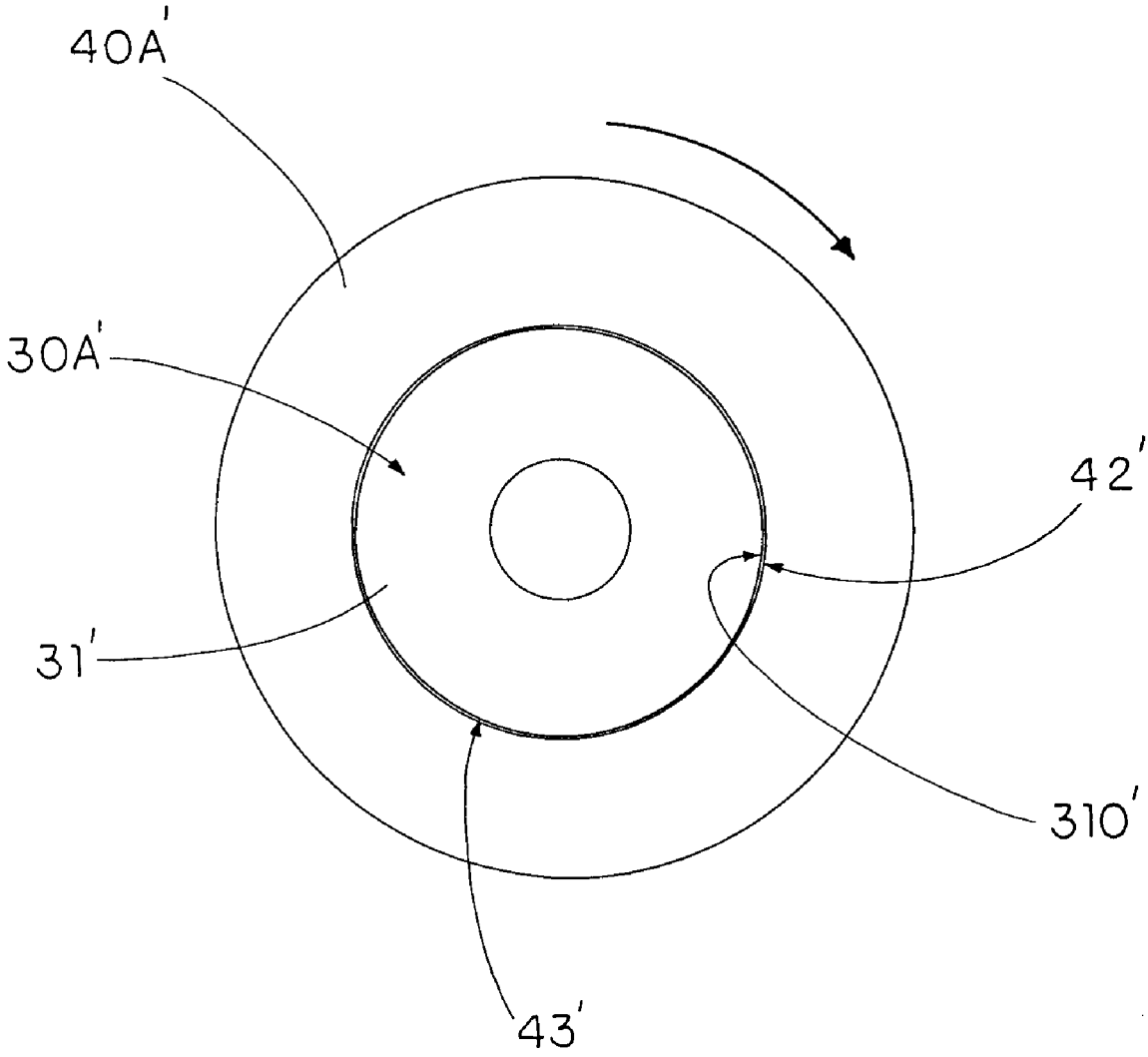
FIG. 7 illustrates an alternative mode of the fixed driving cap of the ignition unit for the disposable childproof lighter according to the above preferred embodiment of the present invention.

FIG. 7 illustrates an alternative mode of the fixed driving cap 41B' of the ignition unit wherein the structural design of the ignition unit is remained the same except that the outer circumferential surface 310' of striker driving wheel 31' of second driven gear element 30A' and inner circumferential surface 42' of fixed driving cap 40B' are substantially smooth, wherein the fixed driving cap 40B' and striker driving wheel 31' are tightly fitted to enable the fixed driving cap 40B' to normally drive striker driving wheel 31' to rotate.

In order to maintain the tight fitting between the fixed driving caps 40' and the striker driving wheel 31' of second driven gear element 30B' at the normal position, the structural design of the fixed driving caps 40B' can be simply modified that the diameter of the driving cavity 43' of each fixed driving cap 40B' is reduced with respect to the striker driving wheel 31'. As a result, the friction between the inner circumferential surface 42' of fixed driving cap 40B' and outer circumferential surface 310' of striker driving wheel 31' enables the fixed driving cap 40B' to drive the striker driving wheel 31' to rotate the striker wheel 20 affixed thereto, as shown in FIG. 7.

In other words, the inner circumferential surface 42' of the fixed driving cap 40B' is normally and frictionally engaged with the outer circumferential surface 310' of the striker driving wheel 31' of the respective driven gear element 30B' such that the fixed driving cap 40B' is rotated to frictionally drive the respective driven gear element 30B' and the striker wheel 20 to rotate.

Figure 8:
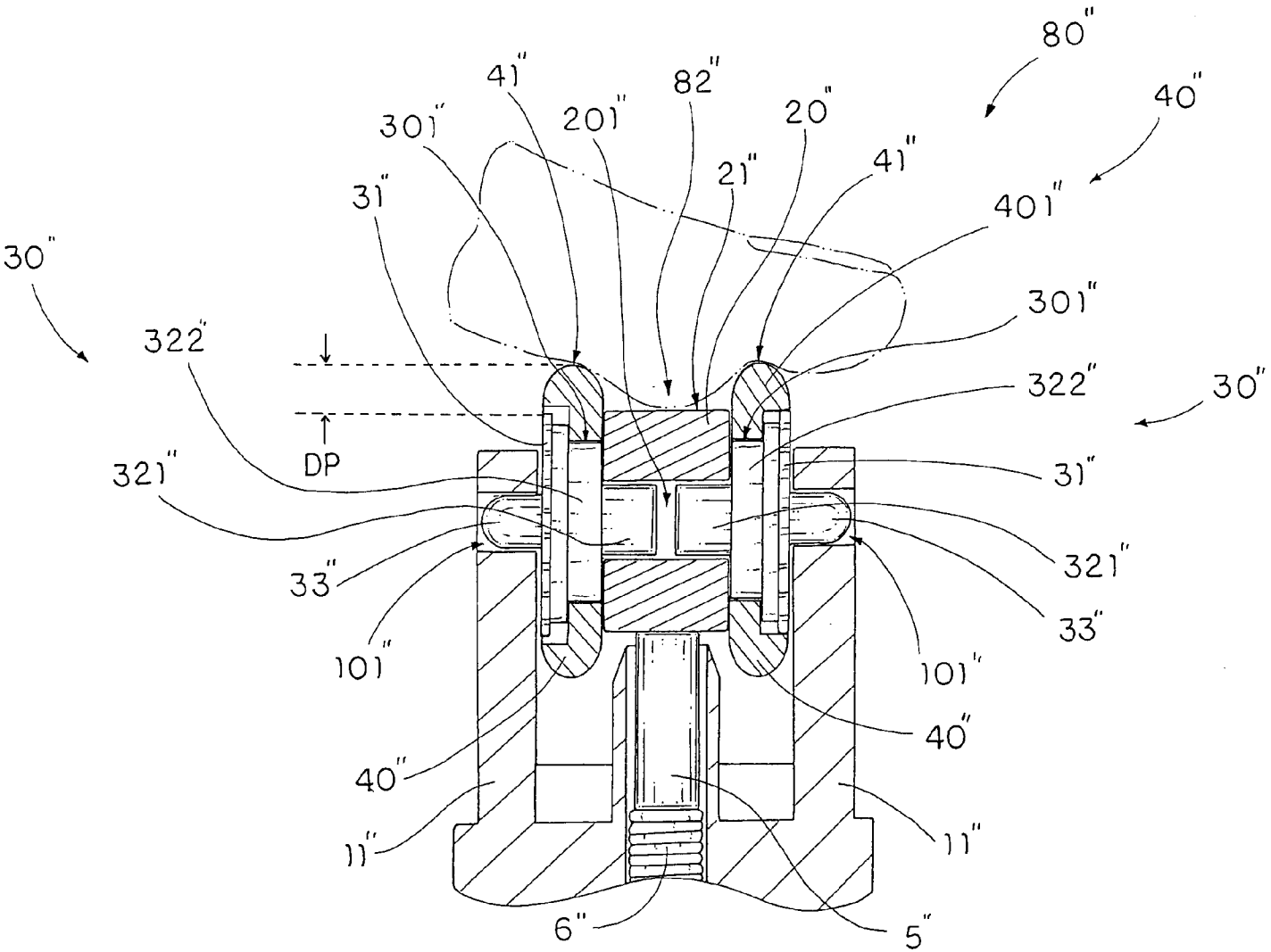
FIG. 8 illustrates an alternative mode of the striker wheel of the ignition unit for the disposable childproof lighter according to the above preferred embodiment of the present invention.

FIG. 8 illustrates an alternative mode of the striker wheel 20" of the ignition unit according to the preferred embodiment of the invention, wherein the structural design of the ignition unit is remained the same except that the striker wheel 20" is free rotated with respect to the driving units 80".

The striker wheel 20" has a central axial hole 201", wherein a plurality of striking teeth 21" are provided on an outer circumferential surface thereof for urging against the flint 5".

The two driving units 80" is arranged for coaxially mounting the striker wheel 20" between the two supporting walls 11". Each driving unit 80 comprises a circular-shaped driving ring 401" having a slipping surface 41" provided an outer circumferential surface and a wheel axle 321" coaxially extended from the driving ring 401" to rotatably insert into the central axial hole 201" of the striker wheel 20".

The wheel axle 321" of each of the driving units 80" has a diameter substantially smaller than that of the central axial hole 201" of the striker wheel 20" such that the striker wheel 20" is normally free rotated with respect to the driving units 80". The wheel axles 321" of driving units 80" are loosely inserted into the central axial hole 201" to define a concave portion 82" among the driving rings 401" and striker wheel 20". The concave portion 82" is deep enough to substantially prevent a child user from contacting with the striker wheel 20" by pressing any finger of the child user on the driving rings 401" and shallow enough to substantially allow an adult user to contact the striker wheel 50 by pressing any finger of the adult user on the driving rings 401". The outer circumferential slipping surface 41" of the driving ring 401" is smooth enough to prevent the child user from generating sufficient friction between the outer circumferential slipping surface 41" and any finger of the child user to substantially drive the driving units 80" and rough enough for the adult user to generate sufficient friction between the outer circumferential slipping surface 41" and any finger of the adult to substantially drive the driving units 80". As a result, while the striker wheel 20" normally free rotates about the wheel axles 321" of the driving units 80", the child user is substantially prevented from driving the striker wheel 20" against the flint 5" to generate sparks as the adult user is capable of doing so.

In other words, an adult's thumb is large enough to apply a sufficient pressure on the slipping surfaces 41" of the driving rings 401" to deform a thumb surface of the adult to frictionally engage with the outer circumferential surface of said striker wheel 20" between the two driving rings 401" so as to drive the striker wheel 20" to rotate for striking against the flint 5" to produce sparks.

As shown in FIG. 8, each of the driving units 80" comprises a driven gear element 30" and a driving cap 40". The two driven gear elements 30" is adapted for coaxially mounting the striker wheel 20" between the two supporting walls 11", wherein each of the driven gear elements 30" comprises a striker driving wheel 31" having an outer circumferential surface and a support shank 32" integrally and coaxially protruded from an inner side of the striker driving wheel 31". The two wheel axles 321" are coaxially protruded from the two support shanks 32" respectively to rotatably insert into two sides of the striker wheel 20" to define two supporting gaps 301" between the two sides of the striker wheel 20" and the two striker driving wheels 31" respectively, and the two striker driving wheels 31" are arranged for respectively and rotatably mounting to the two supporting walls 11" in such a manner that the striker wheel 20" is normally free rotated with respect to the wheel axles 321".

Each of the two driving caps 40" comprises an inner sidewall 44" extending from a circular edge of the driving ring 401", wherein each of the driving ring 401" has an inner circumferential surface 42", and a circular driving cavity 43" formed within the driving ring 401" and the inner sidewall 44". Each of the driving cavities 43" has a diameter larger than that of the striker driving wheels 31" of the driven gear elements 30", wherein each of the inner sidewalls 44" has a central support hole 440" for the support shank 32" of the respective driven gear element 30" passing through while the respective striker driving wheel 31" is received in the driving cavity 43", wherein the two inner sidewalls 44" of the driving caps 40" are disposed in the two supporting gaps 301" respectively so as to hold the two driving caps 40" in a position between the striker wheel 20" and the two driven gear elements 30" respectively, wherein the driving caps 40" are arranged to engage with the striker driving wheels 31".

The slipping surface 41" of each of the driving caps 40", having a round shaped, is radially projected to form the outer circumferential surface of the driving ring 401", wherein a thickness of the driving ring 401" is gradually reduced from a mid-portion to two outer edges thereof so as to form the round slipping surface 41" of the driving cap 40".

Accordingly, the depth DP of the concave portion 82" is too deep for a child's finger to reach the striker wheel 20" due to its insufficient thickness of flesh on his/her thumb, and sallow enough for an adult's finger to reach the striker wheel 20" due to his/her sufficient thickness of flesh. Although the rotation of the striker driving wheels 31" may not directly drive the striker wheel 20" to rotate, it may facilitate the rotation due to the fraction between the sides of the striker driving wheels 31" and striker wheel 20".

The various ways of connection, including actual engagement of gears, loose and adaptive engagement of gears, loose fitting and tight fitting, between the driving cap 40" and striker driving wheel 31" as discussed in FIGS. 4 through 7 can also apply to this preferred embodiment. All of them can be independently selected for each set of driving cap 40" and striker driving wheel 31".

Accordingly, the two driving caps 40" are embodied as a free rotating driving cap 40A, 40A' and a fixed driving cap 40B, 40B' respectively as shown in FIGS. 4 through 7 such that one of the driving caps 40" is in a free rotation manner while another driving cap 40" is normally engaged with the respective striker driving wheel 31".

It is obvious that the two driving caps 40" are embodied as two free rotating driving caps 40A, 40A, as shown in FIGS. 4 and 6 such that the two driving caps 40" are free rotated with respect to the striker driving wheels 31". Thus, the two driving caps 40" are embodied as two fixed driving caps 40B, 40B', as shown in FIGS. 5 and 7, such that the two driving caps 40" are normally engaged with the striker driving wheels 31" respectively.

Figure 9:
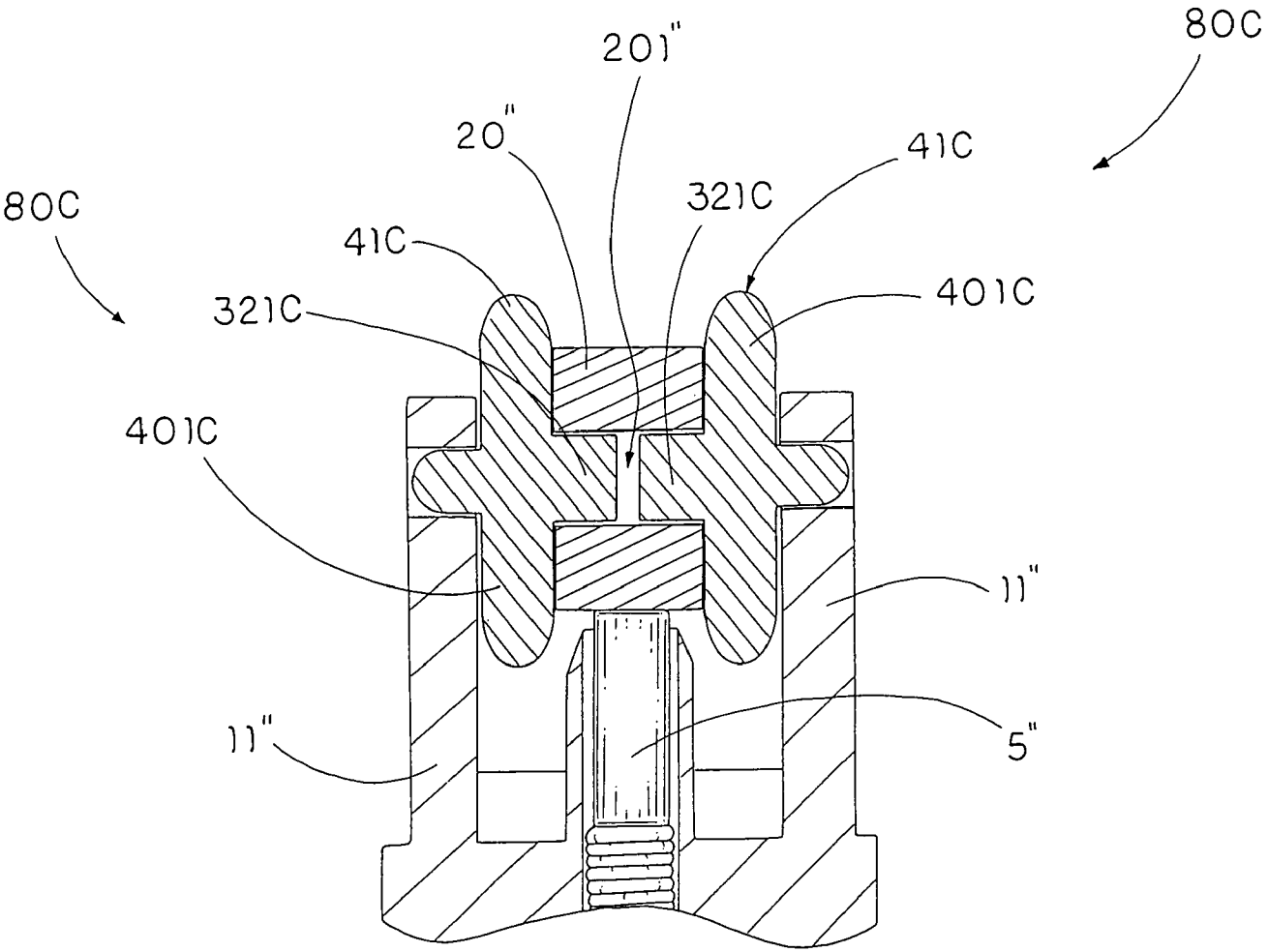
FIG. 9 illustrates an alternative mode of the driving unit of the ignition unit for the disposable childproof lighter according to the above preferred embodiment of the present invention.

Alternatively, each of the wheel axles 321C is integrally and coaxially extended from an inner side of the respective driving ring 401C to form the driving unit 80C in a one-piece integral manner while the striker wheel 20" normally free rotates with respect to wheel axles 321C of driving units 80C, as shown in FIG. 9

Thus, the slipping surface 41C of each of the driving ring 401C, having a round shaped, is radially projected to form the outer circumferential surface of the driving ring 401C, wherein a thickness of the driving ring 401C is gradually reduced from a mid-portion to two outer edges thereof so as to form the round slipping surface 41C of the driving cap 40C.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An ignition unit for a disposable childproof lighter which comprises two supporting walls and a flint supported by a resilient element at a position between said two supporting walls, wherein said ignition unit, which is adapted for rotatably mounting between said two supporting walls, comprises:

a striker wheel having a plurality of striking teeth provided on an outer circumferential surface thereof for urging against said flint;

two driven gear elements for coaxially mounting said striker wheel between said two supporting walls, wherein each of said driven gear elements comprises a striker driving wheel having an outer circumferential surface and a support shank integrally and coaxially protruded from an inner side of said striker driving wheel, wherein said two support shanks, which are smaller than said two striker driving wheels in diameter, are coaxially mounted on two sides of said striker wheel to define two supporting gaps between said two sides of said striker wheel and said two striker driving wheels respectively, and said two striker driving wheels are arranged for respectively and rotatably mounting to said two supporting walls in such a manner that said striker wheel is capable of being driven to rotate when said two striker driving wheels are driven to rotate; and two driving caps, which are a free rotating driving cap and a fixed driving cap respectively, each comprising a driving ring and an inner sidewall extending from a circular edge of said driving ring, wherein each of said driving rings has a smooth outer circumferential slipping surface, an inner circumferential surface, and a circular driving cavity formed within said driving ring and said inner sidewall, said driving cavity of said free rotating driving cap having a diameter larger than that of said striker driving wheel of said respective driven gear element such that said free rotating driving cap is normally free rotated with respect to said respective driven gear element, said driving cavity of said fixed driving cap having a diameter slightly larger than that of said striker driving wheel of said another driven gear element such that said fixed driving cap is normally engaged with said respective driven gear element, wherein each of said inner sidewalls has a central support hole for said support shank of said respective driven gear element passing through while said respective striker driving wheel is received in said driving cavity, wherein said two inner sidewalls of said driving caps are disposed in said two supporting gaps respectively so as to hold said two driving caps in a position between said striker wheel and said two driven gear elements respectively, wherein said free rotating driving cap and said fixed driving cap are arranged to engage with said striker driving wheels to drive said driven gear elements to rotate respectively, so as to drive said striker wheel to rotate for striking against said flint to produce sparks, wherein said free rotating driving cap and said fixed driving cap create a rotational differentiation with respect to said striker wheel for enhancing a childproof feature of said disposable childproof lighter;

wherein said slipping surface of each said driving caps, having a round shaped, is radially projected to form said outer circumferential surface of said driving ring, wherein a thickness of said driving ring is gradually reduced from a mid-portion to two outer edges thereof so as to form said round slipping surface of said driving cap, so as to maximize a distance between said mid-portion of each of said driving caps and said outer circumferential surface of said striker wheel.

2. The ignition unit, as recited in claim 1, further comprising a plurality of driving teeth spacedly provided on said inner circumferential surface of said free rotating driving cap and a plurality of driven gear teeth spacedly provided on said outer circumferential surface of said striker driving wheel of said respective driven gear element, wherein said respective striker driving wheel is driven to rotate by said free rotating driving cap when said driven teeth are engaged with said driving teeth, wherein said free rotating driving cap is normally rotated about said respective driven gear element in a free rotatably movable manner unless a downward force is intentionally applied on said free rotating driving cap while rotating said free rotating driving cap to drive said respective driven gear element and said striker wheel to rotate.

3. The ignition unit, as recited in claim 2, further comprising a second set of driving teeth spacedly provided on said inner circumferential surface of said fixed driving cap and a second set of driven gear teeth spacedly provided on said outer circumferential surface of said striker driving wheel of said respective driven gear element, wherein said driving teeth of said fixed driving cap are normally engaged with said driven gear teeth of said fixed driving cap such that when said fixed driving cap is intentionally rotated, said respective driven gear element and said striker wheel are driven to rotate.

4. The ignition unit, as recited in claim 1, wherein said inner circumferential surface of said fixed driving cap is normally and frictionally engaged with said outer circumferential surface of said striker driving wheel of said respective driven gear element such that said fixed driving cap is rotated to frictionally drive said respective driven gear element and said striker wheel to rotate.

5. The ignition unit, as recited in claim 4, wherein said free rotating driving cap is normally rotated about said respective driven gear element in a free rotatably movable manner unless a downward force is intentionally applied on said free rotating driving cap to frictionally engage said inner circumferential surface of said free rotating driving cap with said outer circumferential surface of said striker driving wheel of said respective driven gear element while rotating said free rotating driving cap to drive said respective driven gear element and said striker wheel to rotate.

6. The ignition unit, as recited in claim 5, further comprising a plurality of driving teeth spacedly provided on said inner circumferential surface of said fixed driving cap and a plurality of driven gear teeth spacedly provided on said outer circumferential surface of said striker driving wheel of said respective driven gear element, wherein said driving teeth of said fixed driving cap are normally engaged with said driven gear teeth of said fixed driving cap such that when said fixed driving cap is intentionally rotated, said respective driven gear element and said striker wheel are driven to rotate.

7. The ignition unit, as recited in claim 5, wherein said inner circumferential surface of said fixed driving cap is normally and frictionally engaged with said outer circumferential surface of said striker driving wheel of said respective driven gear element such that said fixed driving cap is rotated to frictionally drive said respective driven gear element and said striker wheel to rotate.

8. An ignition unit for a disposable childproof lighter which comprises two supporting walls and a flint supported by a resilient element at a position between said two supporting walls, wherein said ignition unit, which is adapted for rotatably mounting between said two supporting walls, comprises:

a striker wheel having a central axial hole, wherein a plurality of striking teeth are provided on an outer circumferential surface thereof for urging against said flint; and two driving units for coaxially mounting said striker wheel between said two supporting walls, each comprising a circular-shaped driving ring having an outer circumferential slipping surface and a wheel axle coaxially extended from said driving ring to rotatably insert into said central axial hole of said striker wheel, wherein said wheel axle has a diameter substantially smaller than that of said central axial hole such that said striker wheel is normally free rotated with respect to said driving units, wherein each of said driving units comprises a driven gear element and a driving cap, wherein said two driven gear elements is adapted for coaxially mounting said striker wheel between said two supporting walls, wherein each of said driven gear elements comprises a striker driving wheel having an outer circumferential surface and a support shank integrally and coaxially protruded from an inner side of said striker driving wheel, wherein said two wheel axles are coaxially protruded from said two support shanks respectively to rotatably insert into two sides of said striker wheel to define two supporting gaps between said two sides of said striker wheel and said two striker driving wheels respectively, and said two striker driving wheels are arranged for respectively and rotatably mounting to said two supporting walls in such a manner that said striker wheel is normally free rotated with respect to said wheel axles, and wherein each of said two driving caps comprises an inner sidewall extending from a circular edge of said driving ring, wherein each of said driving ring has an inner circumferential surface, and a circular driving cavity formed within said driving ring and said inner sidewall, each of said driving cavities having a diameter larger than that of said striker driving wheels of said driven gear elements, wherein each of said inner sidewalls has a central support hole for said support shank of said respective driven gear element passing through while said respective striker driving wheel is received in said driving cavity, wherein said two inner sidewalls of said driving caps are disposed in said two supporting gaps respectively so as to hold said two driving caps in a position between said striker wheel and said two driven gear elements respectively, wherein said driving caps are arranged to engage with said striker driving wheels;

wherein said two driving caps are embodied as a free rotating driving cap and a fixed driving cap respectively, said driving cavity of said free rotating driving cap having a diameter larger than that of said striker driving wheel of said respective driven gear element such that said free rotating driving cap is normally free rotated with respect to said respective driven gear element, said driving cavity of said fixed driving cap having a diameter slightly larger than that of said striker driving wheel of said another driven gear element such that said fixed driving cap is normally engaged with said respective driven gear element, wherein said free rotating driving cap and said fixed driving cap create a rotational differentiation with respect to said striker wheel for enhancing a childproof feature of said disposable childproof lighter;

wherein said slipping surface of each said driving caps, having a round shaped, is radially projected to form said outer circumferential surface of said driving ring, wherein a thickness of said driving ring is gradually reduced from a mid-portion to two outer edges thereof to form said round slipping surface of said driving cap, so as to maximize a distance between said mid-portion of each of said driving caps and said outer circumferential surface of said striker wheel;

whereby an adult's thumb is large enough to apply a sufficient pressure on said slipping surfaces of said driving rings to deform a thumb surface of said adult to frictionally engage with said outer circumferential surface of said striker wheel so as to drive said striker wheel to rotate for striking against said flint to produce sparks.

9. The ignition unit, as recited in claim 8, further comprising a plurality of driving teeth spacedly provided on said inner circumferential surface of said free rotating driving cap and a plurality of driven gear teeth spacedly provided on said outer circumferential surface of said striker driving wheel of said respective driven gear element, wherein said respective striker driving wheel is driven to rotate by said free rotating driving cap when said driven teeth are engaged with said driving teeth, wherein said free rotating driving cap is normally rotated about said respective driven gear element in a free rotatably movable manner unless a downward force is intentionally applied on said free rotating driving cap while rotating said free rotating driving cap to drive said respective driven gear element to rotate.

10. The ignition unit, as recited in claim 9, further comprising a second set of driving teeth spacedly provided on said inner circumferential surface of said fixed driving cap and a second set of driven gear teeth spacedly provided on said outer circumferential surface of said striker driving wheel of said respective driven gear element, wherein said driving teeth of said fixed driving cap are normally engaged with said driven gear teeth of said fixed driving cap such that when said fixed driving cap is intentionally rotated, said respective driven gear element is driven to rotate.

11. The ignition unit, as recited in claim 9, wherein said inner circumferential surface of said fixed driving cap is normally and frictionally engaged with said outer circumferential surface of said striker driving wheel of said respective driven gear element such that said fixed driving cap is rotated to frictionally drive said respective driven gear element to rotate.

12. The ignition unit, as recited in claim 8, wherein each of said wheel axles is integrally and coaxially extended from an inner side of said respective driving ring to form said driving unit in a one-piece integral manner.

13. The ignition unit, as recited in claim 10, wherein each of said wheel axles is integrally and coaxially extended from an inner side of said respective driving ring to form said driving unit in a one-piece integral manner.

14. The ignition unit, as recited in claim 11, wherein each of said wheel axles is integrally and coaxially extended from an inner side of said respective driving ring to form said driving unit in a one-piece integral manner.

* * * * *